United States Patent [19]

Scheiber

[11] 4,273,798

[45] Jun. 16, 1981

[54] PROCESS FOR COATING METAL TUBES WITH PLASTIC MATERIALS

[75] Inventor: Werner Scheiber, Frankfurt am Main, Fed. Rep. of Germany

[73] Assignee: Metallgesellschaft Aktiengesellschaft, Frankfurt am Main, Fed. Rep. of Germany

[21] Appl. No.: 53,654

[22] Filed: Jun. 29, 1979

[30] Foreign Application Priority Data

Jul. 12, 1978 [DE] Fed. Rep. of Germany ..... 2830593

[51] Int. Cl.[3] ..... B05D 1/06; B05D 7/22

[52] U.S. Cl. ..... 427/27; 118/622; 118/310; 118/317; 118/500; 118/DIG. 10; 118/DIG. 11; 427/28; 427/29; 427/195; 427/239

[58] Field of Search ..... 427/181, 182, 183, 195, 427/27, 28, 29, 239; 118/622, 624, 310, 317, 318, 500, DIG. 10, DIG. 11

[56] References Cited

U.S. PATENT DOCUMENTS

| | | | |
|---|---|---|---|
| 3,108,022 | 10/1963 | Church | 427/182 X |
| 3,207,618 | 9/1965 | De Hart | 427/182 |
| 3,687,704 | 8/1972 | Stanley et al. | 118/DIG. 11 |
| 3,814,616 | 6/1974 | Konodo et al. | 427/28 |
| 3,850,660 | 11/1974 | Inamura et al. | 427/28 |
| 3,946,125 | 3/1976 | Scheiber | 118/DIG. 10 X |
| 3,965,854 | 6/1976 | Scheiber | 118/DIG. 11 X |
| 4,122,798 | 10/1978 | Gibson | 427/182 X |

FOREIGN PATENT DOCUMENTS

| | | | |
|---|---|---|---|
| 756565 | 4/1967 | Canada | 427/183 |
| 1204632 | 9/1970 | United Kingdom | 427/182 |

*Primary Examiner*—Shrive P. Beck

*Attorney, Agent, or Firm*—Sprung, Felfe, Horn, Lynch & Kramer

[57] ABSTRACT

A process for applying a coating of plastic material to a metal tube of finite length having a pretreated surface by applying plastic coating materials on the metal tube in a direction horizontal and perpendicular to its direction of travel, the process being characterized by the following sequence of steps:

(a) heating a fixed metal tube to a temperature above the melting point of the plastic material to be employed;

(b) causing a mixture of plastic powder and air to pass through the metal tube whereby the plastic material is fritted onto the inside surface of the tube;

(c) thereafter rotating the metal tube and applying to the exterior surface thereof in a plurality of stages a plastic material, said plastic material being electrostatically sprayed onto the rotating metal tube; and (d) after each stage of electrostatically applying plastic to the outside surface of the metal tube and applying plastic material to the inside surface thereof, completely melting and smoothing the plastic material. An apparatus for carrying out the process is also disclosed.

1 Claim, 2 Drawing Figures

PROCESS FOR COATING METAL TUBES WITH PLASTIC MATERIALS

Figure 1:
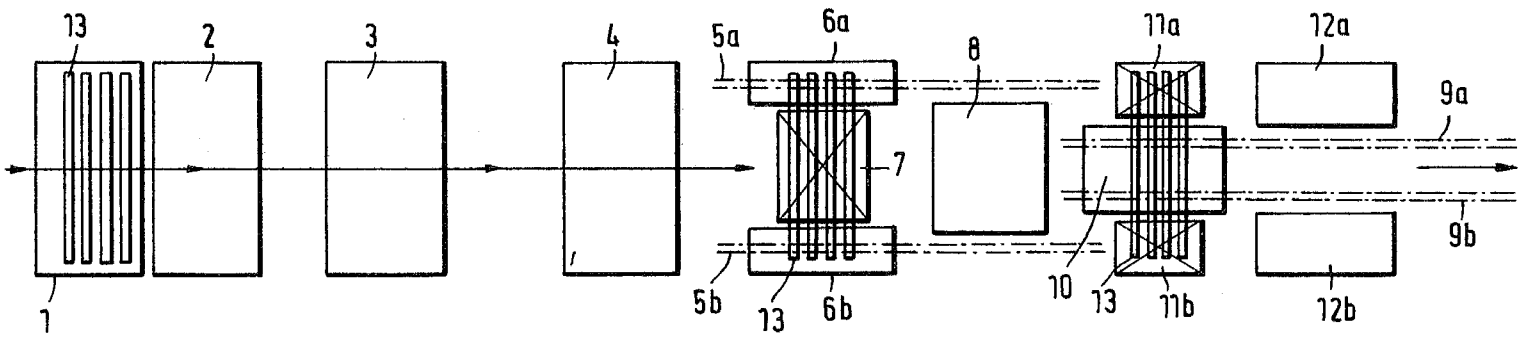

This invention relates to a process and apparatus for applying coatings of plastic material to metal tubes which are of finite length and have a pretreated surface and extend horizontally and at right angles to their direction of travel.

Steel coated with plastic material is a modern composite material, which finds wider and wider application. Plastic-coated wire, woven wire mesh, sheet elements, etc. are offered in increasing quantities. This applies also particularly to steel tubes to be buried in the soil. In such case, the coating with plastic material more and more replaces the much more expensive application of rubber or hot asphalt, followed by wrapping. Steel tubes which are small in diameter, such as are used mainly in the building of houses and equipment, have already been provided with an external coating of plastic material. The inside surface of metal tubes may also be coated with plastic material.

There are numerous processes of coating metal tubes with plastic material. To apply the plastic material, the tubes may be dipped into a plastic material solution or molten material may be applied in either of two processes. The molten plastic material may be extruded on the tube to be coated or plastic material powder may be directly contacted with the heated surface of the tube so that the plastic material powder is fritted onto the heated tube surface and fuses to form a uniform film of plastic material. The latter process is the basis of all powder-melting processes, such as fluidized bed dip coating, electrostatic powder painting, centrifugal sintering, etc. These processes make possible a satisfactory coating of metal tubes at moderate speeds; a uniform thickness of the layer of plastic material is ensured because the tubes are rotated during the coating operation.

German Patent Publication No. 2,052,314 describes a process of forming a plastic material coating on the inside surface of metal tubes which extend horizontally and at right angles to their direction of travel. In that process a preferably turbulent mixture of plastic material powder and air is caused to flow through the tube which is to be coated and said tube is heated by means of an induction coil at the same time so that the plastic material is fritted onto the inside surface of the tube. The induction coil surrounding the tube is then moved along the tube once more so that the layer of plastic material is heated and completely melted.

In accordance with German Patent Specification No. 2,328,403, a coating of plastic material is applied to the outside surface of metal tubes extending horizontally and at right angles to their direction of travel in that plastic material powder is electrostatically applied in two spaced apart stages and the plastic material layer which has been applied in each stage is completely melted after said stage.

It has now been attempted to apply a coating of plastic material on the inside surface of tubes by the process described in German Patent Publication No. 2,052,314 and subsequently to apply a coating of plastic material on the outside of such tubes in accordance with the process described in German Patent Specification No. 2,328,403. In that process sequence, the heating and melting of the plastic material layer applied to the outside surface of the tube inevitably results in an orange peel effect and a formation of pores in the plastic material layer on the inside surface of the tube. By these results, the quality of the plastic material layer is adversely affected to such a high degree that such tubes are not suitable for numerous applicants.

It is an object of the invention to provide a feasible method of coating metal tubes continuously with plastic materials on their inside and outside surfaces in one sequence of operations.

In accordance with the invention this object is accomplished in that the fixed metal tubes are heated in known manner to a temperature above the melting point of the plastic material which is employed, a mixture of plastic material powder and air is caused to flow through the tubes at the same time so that plastic material is fritted onto the inside surface of the tubes, the metal tubes are subsequently coated on their outside surface in a plurality of stages, preferably in two stages, in those areas which do not rest on the conveyor with plastic material, which is sprayed in an electrostatic field, and after each stage the plastic material layers which have been applied to the outside surface of the metal tubes in said stage and the plastic layer fritted onto the corresponding area of the inside surface are completely melted and smoothed.

The apparatus for carrying out the process consists of holders for fixing the metal tubes, a coating and heating device for fritting plastic material onto the inside surface of the metal tubes, and two coating devices, two heating devices, and two successively disposed, horizontally extending carrying chain conveyors for use in the coating of the metal tubes on the outside and in the complete melting and smoothing of the plastic material layers, the spacing of the chains of one carrying chain conveyor differing from the spacing of the chains of the other carrying chain conveyor.

The apparatus for carrying out the process is suitably preceded by means for applying a primer to the inside surfaces of the metal tube and an oven for baking said primer.

The apparatus for carrying out the process is shown diagrammatically and by way of example on the drawing and will now be explained in its function.

FIG. 1 is a top plan view and

Figure 2:
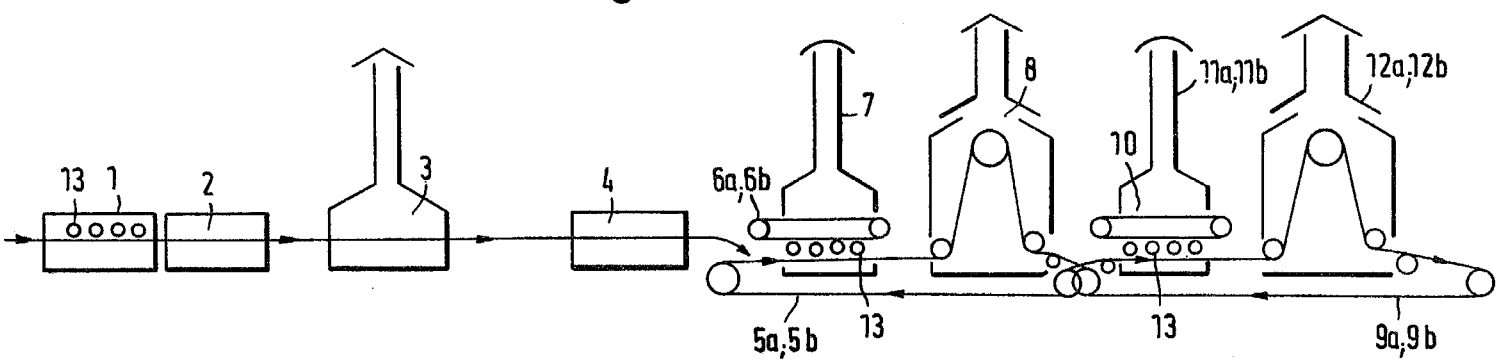

FIG. 2 a side elevation showing the apparatus.

Precision steel tubes 13 according to (Deutshe Industrie Norm) 2393, which have been degreased and derusted on their inside and outside surfaces and have a length of 6 m, a diameter of 28 mm and a wall thickness of 1.5 mm are fed into the coating line at 1.

In the coating device 2, the tubes 13 are coated on the inside with a primer in a thickness of about 15 microns. Coating is effected by means of lances, which are introduced into the tubes 13.

In the baking oven 3, the tubes are then heated to 250° C. in order to bake the primer.

The tubes 13 are then fed to a coating unit 4, in which the tubes 13 are heated and polyamide-11 powder in a layer having a thickness of 200 microns is uniformly fritted onto the inside surface of the tubes. This fritting of polyamide 11 is accomplished in that a mixture of polyamide-11 powder and air is caused to flow through the fixed tubes and the tubes 13 are heated sufficiently above the melting point of the polyamide 11 at the same time so that a layer in the desired thickness is fritted onto the inside surface of the tube from the mixture of polyamide-11 powder and air. Polyamide-11 powder which has not been consumed in the coating operation is blown out of the tubes 13. Heating is effected in that induction coils surrounding the tubes are moved along the same in a direction opposite to the flow of the polyamide-11 powder and air. The tubes are then applied to the carrying chain conveyor 5*a, b* and moved through the coating chamber 7.

The two revolving pressure-applying belts 6*a, b* force the tubes down against the carrying chain conveyor 5*a, b* and rotate the tubes at the same time.

In this operation, epoxide resin powder is sprayed in an electrostatic field so that an epoxide resin layer is applied to the outside surface of the tubes 13, except for their end portions. The tubes 13 are then moved through the oven 8 in order to completely melt and to cure the epoxy resin layer which has been applied to the outside surface and the polyamide-11 layer which has been applied to the corresponding area of the inside surface of the tubes.

The tubes 13 are then transferred to the carrying chain conveyor 9*a, b* and moved by it into the coating booths 11*a, b,* in which the tubes are forced by the revolving pressure-applying belt 10 against the chain conveyor 9*a, b* and are rotated at the same time.

In the coating booths 11*a, b,* those end portions of the tubes 13 which have not yet been coated are coated with epoxy resin powder which is sprayed in an electrostatic field.

The tubes 13 are subsequently moved by the conveyor 9*a, b* into the ovens 12*a, b,* in which the plastic material layers applied to the outside surface and the corresponding areas of the inside surface are completely melted and cured.

The invention provides an advantageous process in which metal tubes can be provided in a fully continuous operation on their inside and outside surfaces with smooth plastic material coatings of high quality.

For comparison, steel tubes were pretreated and provided on the inside surface with polyamide 11 fritted on in accordance with the first embodiment. Before the tubes were fed to the devices for applying an epoxy resin layer to the outside surface of the tubes, the latter were reheated by means of an induction coil, which surrounded the metal tube and was moved along the tube to reheat the latter so that the fritted polyamide-11 layer was completely melted and smoothed. The metal tubes which had been coated on the inside with polyamide 11 were then coated with epoxy resin on the outside in the manner described for the first embodiment.

A strictly visual inspection of the plastic material coatings had the result that the plastic material layers applied to the outside surface of the metal tube met the requirements regarding surface finish and bond strength but the plastic material layers on the inside surface of the metal tubes exhibited numerous pores as well as orange peel and schlieren effects.

We claim:

1. In a process of applying a coating of plastic material to both the inside surface and the outside surface of a metal tube of finite length wherein the metal tube is by means of a plurality of successively disposed, horizontally extending carrying conveyors which contact and support said tube in different locations, passed in a direction of travel such that its longitudinal axis is perpendicular to said direction of travel the improvement wherein the metal tube is coated according to the following sequence of process steps:

(A) The metal tube is heated to a temperature above the melting point of the plastic material to be applied thereto, (B) the plastic material in the form of a powder is together with air applied to the so-heated metal tube on the inside surface thereof and said plastic material is fritted onto said inside surface.

(C) said metal tube is then rotated and subsequently coated on the outside surface thereof except for its end portion which are supported by said conveyor in a plurality of steps with plastic material sprayed thereon by an electrostatic spray process, and (D) thereafter the end portions are coated with a plastic material by an electrostatic spray process while said tube is supported by said conveyor in a different location, and (E) after each stage in which the plastic material is applied to the outside surface of the tube and at the stage wherein the plastic material is applied to the end portions of the tube, the tube is heated to melt and cure the plastic material applied to the outside surface or end portion and the plastic material which had been applied to the corresponding area of the inside surface.

* * * * *